US011547247B2

(12) United States Patent
Ellison

(10) Patent No.: US 11,547,247 B2
(45) Date of Patent: Jan. 10, 2023

(54) DEVICE FOR BATHING OLDER BABIES ALLOWING THE FREEDOM OF APPROPRIATE MOVEMENTS

(71) Applicant: Norman Ellison, Paris (FR)

(72) Inventor: Norman Ellison, Paris (FR)

( * ) Notice: Subject to any disclaimer, the term of this patent is extended or adjusted under 35 U.S.C. 154(b) by 0 days.

(21) Appl. No.: 17/272,301

(22) PCT Filed: Sep. 2, 2019

(86) PCT No.: PCT/EP2019/073362

§ 371 (c)(1),
(2) Date: Feb. 27, 2021

(87) PCT Pub. No.: WO2020/048926

PCT Pub. Date: Mar. 12, 2020

(65) Prior Publication Data

US 2021/0393087 A1 Dec. 23, 2021

(30) Foreign Application Priority Data

Sep. 9, 2018 (FR) ..... 1871010

(51) Int. Cl.

| | |
|---|---|
| ***A47K 3/034*** | (2006.01) |
| ***A47K 3/064*** | (2006.01) |
| ***A47K 3/12*** | (2006.01) |
| ***A47K 3/17*** | (2006.01) |

(52) U.S. Cl.

CPC ..... *A47K 3/034* (2013.01); *A47K 3/064* (2013.01); *A47K 3/127* (2013.01); *A47K 3/17* (2013.01)

(58) Field of Classification Search

CPC ..... A47K 3/034; A47K 3/064; A47K 3/127; A47K 3/17

USPC ..... 4/572.1

See application file for complete search history.

(56) References Cited

U.S. PATENT DOCUMENTS

| | | | | |
|---|---|---|---|---|
| 3,339,213 | A | 9/1967 | Spencer | |
| 5,588,159 | A | 12/1996 | Poulson | |
| 10,433,679 | B2 * | 10/2019 | Kwak | A47K 3/127 |
| 2007/0220669 | A1 * | 9/2007 | Monti | A47K 3/127 4/572.1 |
| 2008/0141452 | A1 | 6/2008 | Karbowski | |

(Continued)

FOREIGN PATENT DOCUMENTS

| | | | |
|---|---|---|---|
| CN | 204931505 | U | 1/2016 |
| CN | 107638110 | A | 1/2018 |
| CN | 108095608 | A | 6/2018 |

*Primary Examiner* — Huyen D Le

(74) *Attorney, Agent, or Firm* — Scot S. Fagerland, Esq.

(57) ABSTRACT

A device for bathing infants aids the development of infants by allowing them freedom of movement appropriate to their stage of development. In one embodiment, a basin has an inclined surface with a drainage hole and a plug. In a second embodiment, a basin has a substantially flat bottom and walls shaped to allow the baby to sit in different positions transversely and longitudinally. Preferably, the bottom of this seated baby basin has feet to raise it off the bottom of the adult shower or bathtub. The basin has a perimeter comprising a flexible wall connected to an upper frame and a lower frame, adapted to allow an infant to sit, bend, kneel, walk, or crawl. Preferably, the tension of the flexible wall such as mesh fabric or the equivalent contributes to the good mechanical behavior of the periphery.

6 Claims, 19 Drawing Sheets

(56) References Cited

U.S. PATENT DOCUMENTS

2008/0295239 A1* 12/2008 Ristuccia ..... A47K 3/024
4/589
2013/0198947 A1* 8/2013 Yeung ..... A47K 3/00
4/559

* cited by examiner

DEVICE FOR BATHING OLDER BABIES ALLOWING THE FREEDOM OF APPROPRIATE MOVEMENTS

FIELD OF THE INVENTION TO WHICH THE INVENTION RELATES

The present invention relates generally to the field of devices for bathing infants such as babies, by providing aids for their development because it also offers more space, possibilities for body movements and water play suitable for their age. To our knowledge, this is unique among all devices used for bathing infants, devices intended for use in an ordinary shower, bathtub or elsewhere.

Depending on the age of the baby, the present invention allows freedom of movement appropriate to their stage of development.

- for infants in the first stage, that is to say who can neither sit nor stand (approximately from birth to 6 months)
- for babies at the second stage, that is to say who can be seated either by themselves or with the assistance of an adult (approximately 6 months to 1 year)
- for babies in the third stage, that is to say who can sit up on their own and stand up (approximately from one year).

The invention allows freedom of movement adapted to their age: turning onto the side, rolling over, crawling, sitting and standing.

Effectively, in the first stage, babies generally have difficulty lifting the head but they are generally able to turn onto their sides, or onto turn onto their stomachs.

In the second stage, the babies are able to remain seated, but require the close assistance of an adult.

In the third stage, babies can sit up on their own, stand up and move. However, they may be able to sufficiently control their balance in an adult bathtub. Many types of bathing devices attempt to control these children by using straps or a shape that physically constrains the child to remain in a predetermined position. This often creates a more stressful bathing experience for both baby and adult, mainly because during bathing babies are naturally eager to play and move.

In addition, movement and independent play have been shown to be important factors contributing to the development of motor skills in children as well as to their early cognitive development. Bath time in particular is a regular, recurring activity where allowing the baby to move around and play safely is both fun for the baby and in the interests of his development.

PRIOR ART

To our knowledge, this approach is absent from the state of the art described below. We cite these examples:

U.S. Pat. No. 9,049,968B2, 20 Dec. 2010, already filed by the inventor M. Norman Ellison has disclosed a tub for young children which, while allowing the freedom to stand and move, does not allow equivalent movement for infants who have not yet reached this ability. In addition, the lack of a bottom of the tub means that the entire adult tub must be filled with hot water.

U.S. Pat. No. 5,033,131, 20 Jul. 1989, described by Mr. Jack R. Paden describes a tub in the form of a closed structure in which a child can stand while showering. This structure has several drawbacks or differences with respect to the present invention. First, the configuration of the structure is designed to keep the baby upright which only works for infants in the third stage. In addition, even for these babies, the lower area is very cramped which limits the movements of the feet and prevents the child from sitting down and playing. Note that the bottom of the tub is rigid U.S. Pat. No. 5,809,588A, 10 Feb. 1997, filed by Mr. Christopher Angelotti discloses a bathtub offering more space and having a flexible bottom. It only concerns babies in the second stage. In addition, this device does not work in a shower without a bathtub U.S. Pat. No. 6,158,065A, May 22, 1998, filed by Mr Frances Kyra Tuoeriniemi et al., May 22, 1998, describes a bathtub in the form of a vertical cylindrical tank. The child stands in the tub, which retains the water. It can be placed in the tub with a parent. As with the Mr. Jack R. Paden patent, the tub is too cramped to sit on or play. In fact, it is designed to make it easier to stand up which only concerns third-stage infants and excludes younger infants.

BRIEF DESCRIPTION OF THE INVENTION

The invention is a device for bathing infants also designed as a device to aid the development of infants by allowing them freedom of movement appropriate to their stage of development.

At their first stage of development, that is to say for babies who can neither sit nor stand, the invention proposes the presence of a basin comprising a substantially flat surface, inclined according to the longitudinal axis and wide enough to allow the baby to rest on his back, on his stomach and to turn on his side.

Preferably, this basin with its inclined surface has a drainage hole and a plug.

Preferably, this basin is removable to allow other uses

At their second stage of development, that is to say for babies who can be seated either on their own or with the assistance of an adult, a basin is offered with a substantially flat bottom and which the shape of the walls allows the baby to sit in different positions transversely and longitudinally.

It is also proposed to design this basin for a seated baby to allow simultaneous use by at least two babies.

Preferably, the bottom of this seated baby basin has feet to raise it off the bottom of the adult shower or bathtub.

At their third stage of development, that is to say for babies who can sit up on their own and stand up, a basin capable of retaining water and a perimeter comprising a flexible wall connected to an upper frame and a lower frame, adapted to allow an infant to sit, bend, kneel, walk, crawl.

Preferably, the tensioning of the flexible wall such as mesh fabric or equivalent contributes to the good mechanical behavior of the periphery To allow the device to support the development of the baby as and as it grows, a modular structure is proposed which by combinations responds to the different stages.

This modular structure includes the basin adapted to the second stage, that is to say for babies who can be seated, complete as appropriate with a basin with inclined surface suitable for the first stage, that is to say for infants who cannot sit or yet stand, or a perimeter comprising a flexible wall such as a mesh fabric or the like connected to an upper frame and a lower frame adapted to allow an infant to sit, bend, kneel, walk, crawl.

Of course, this modular structure can respond as a whole by combining all of its constituents at the three stages of baby's development.

It is finally proposed that the device may accommodate elements other than water such as foam, textiles, sand, gelatin.

BRIEF DESCRIPTION OF THE DRAWINGS

The drawings include examples of embodiments of the invention, which can be made in various forms. In some instances, various aspects of the invention may be exaggerated or enlarged to facilitate understanding of the invention.

DESCRIPTION OF THE EMBODIMENTS

Figure 1:
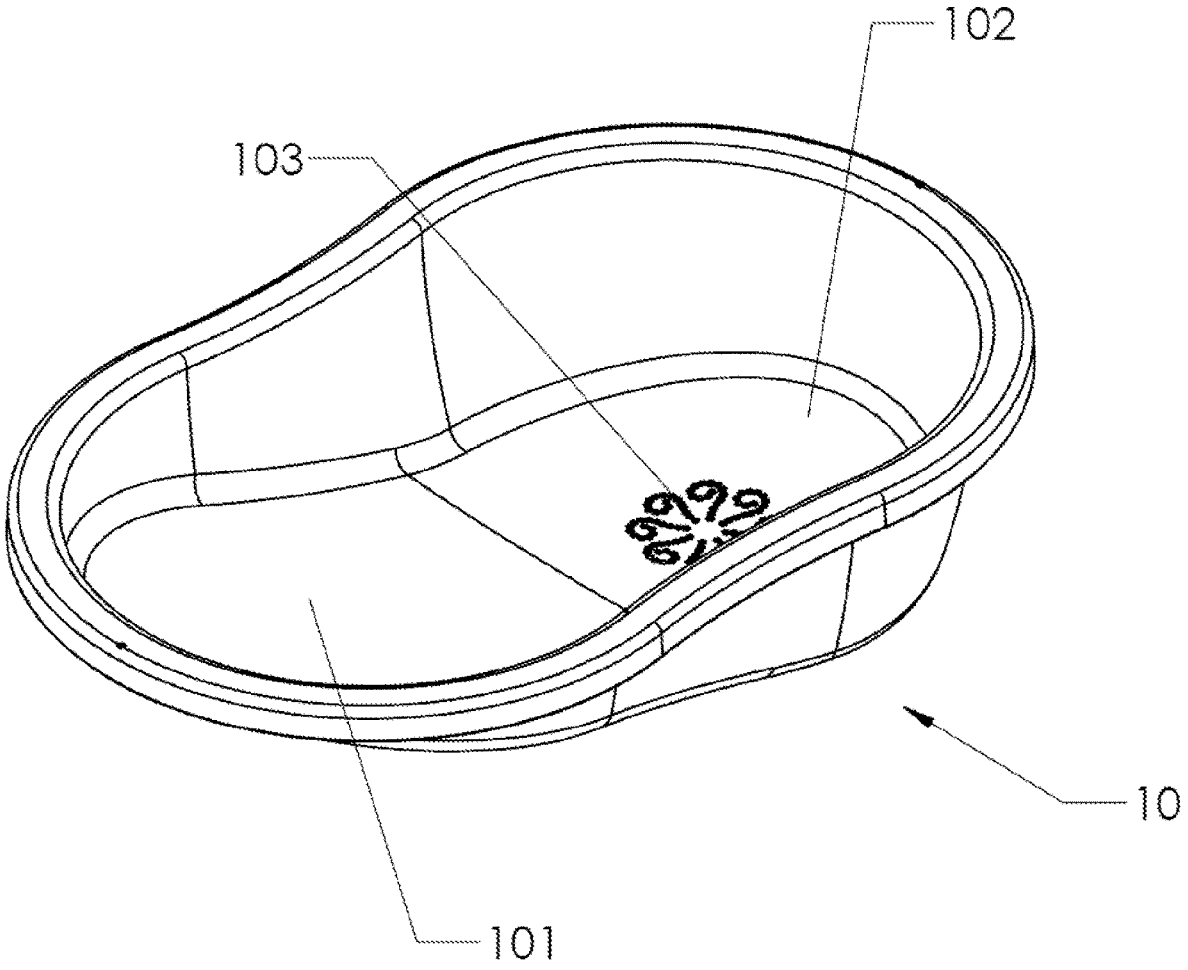
FIG. 1 illustrates an embodiment of the present invention adapted to the first stage, that is for babies who can neither sit nor stand. See FIGS. 1A, 1B and 1 C.

By way of example, one embodiment of the invention will be described. It will be understood that the present invention can be implemented in various forms. Accordingly, the specific details should not be construed as limiting, but rather as a basis for the claims and as a representative basis for teaching those skilled in the art to employ the present invention in any system, At their first stage of development, that is to say for a baby (1) who can neither sit nor still stand, the invention proposes an embodiment shown in FIG. 1.

In this embodiment, the bathing device includes the presence of a basin (10) comprising a substantially straight surface (101) inclined along the longitudinal axis and sufficiently wide to allow the baby (1) to rest on his back. on his stomach and turn on his side.

Preferentially, this surface (101) is smooth and rigid, or at least sufficiently firm to remain flat despite the weight of the baby (1).

This surface (101) must have a minimum width of the order of 30 cm to allow the baby (1) to roll on its side.

The lower area (102) is a space that allows for free movement and can be filled with water.

These characteristics allow the baby (1) to lie down comfortably on his back and to turn around but also to lie down comfortably on his abdomen, which is unique for all known bathtubs. In addition, the incline facilitates the positioning and maintenance of the baby's head (1) out of the water. This incline would be between 10° and 20°, for example 15°. When water is present in the basin, the baby (1) can start rolling sideways more easily due to the effect of buoyancy on the legs and lower torso of the baby (1).

Figure 1A:
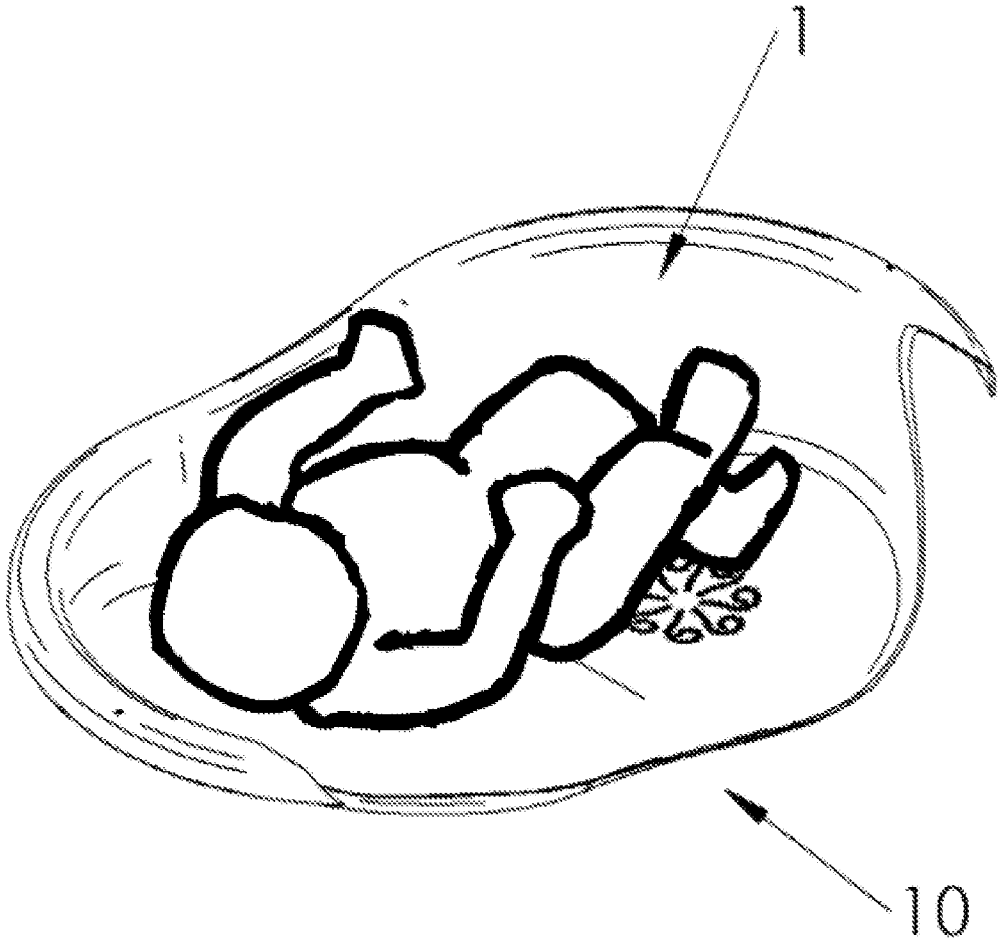

This is represented by the following figures:

FIG. 1A, the baby (1) is on his back

Figure 1B:
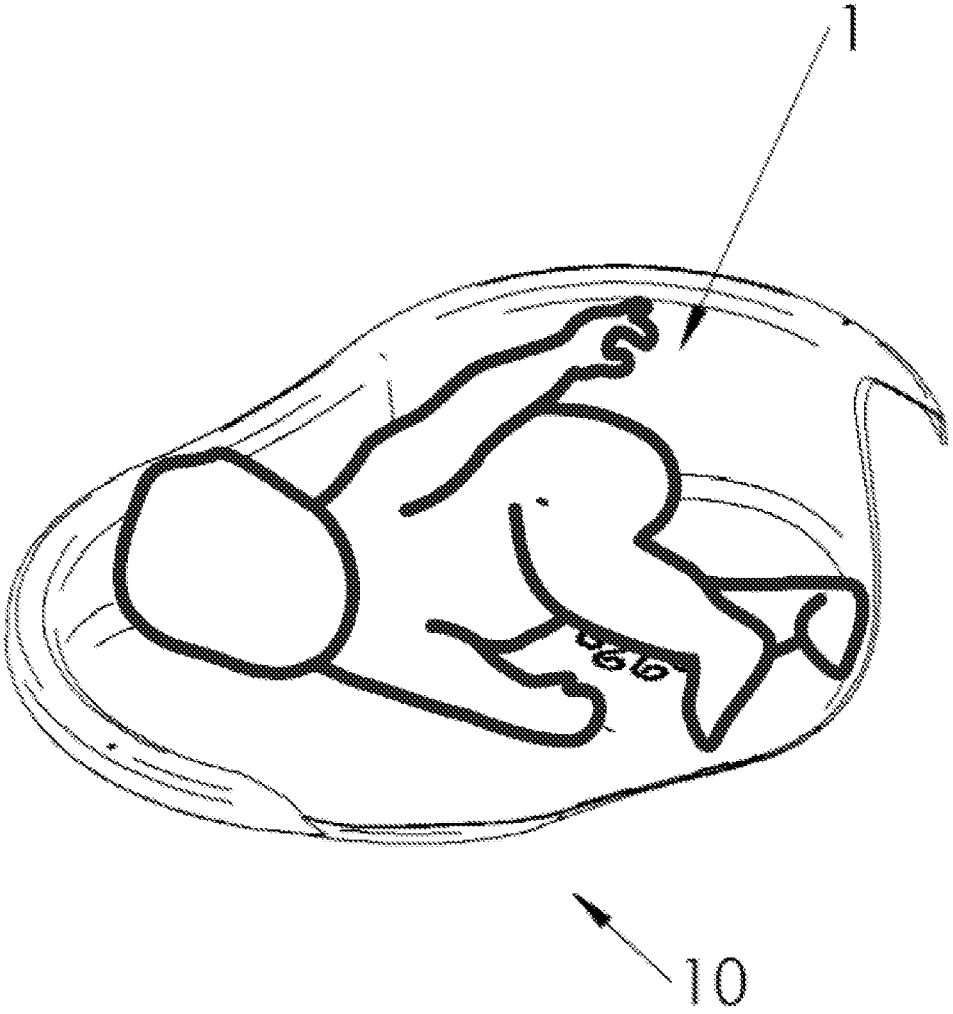

FIG. 1B, the baby (1) changes position

Figure 1C:
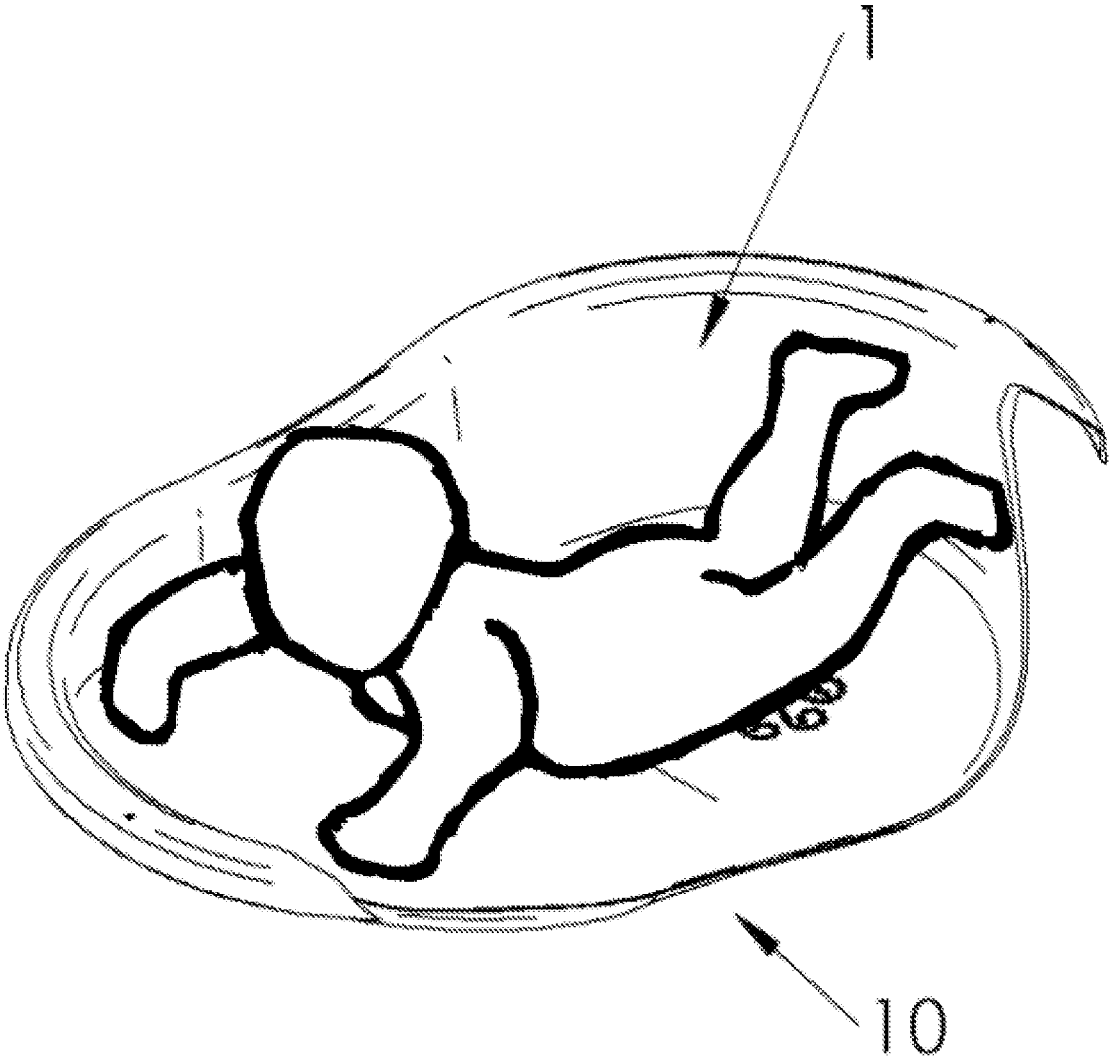

FIG. 1C the baby (1) is on his stomach.

Preferentially, this basin (10) with its inclined surface (101) has a drain (103) and its plug, not shown. Note that preferentially, this drain is made in the form of a set of fine slits or holes of sufficiently small dimensions so as not to present a risk to the fingers of the hand and the toes of the baby (1).

Figure 2:
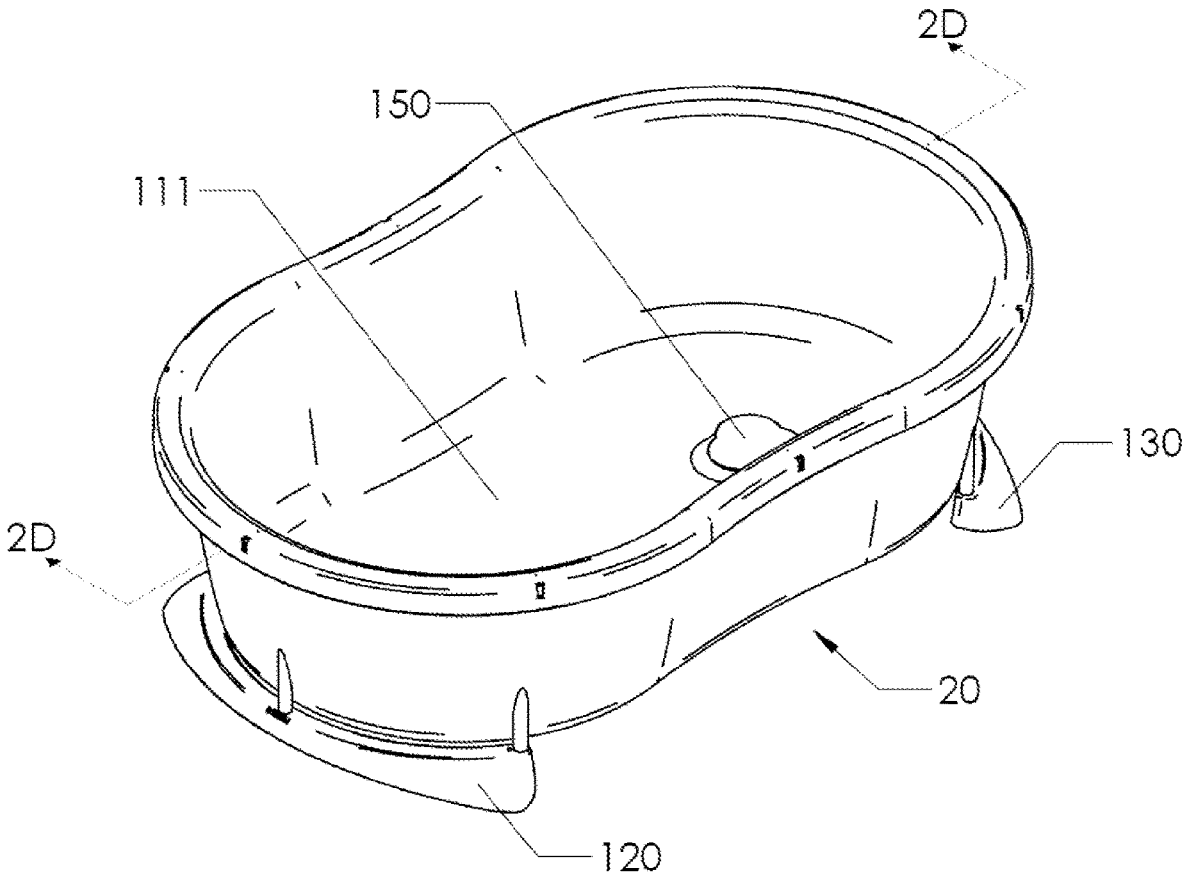
FIG. 2 illustrates an embodiment of the present invention adapted to the second stage, that is for babies who can be seated with different positions. See FIGS. 2A and 2B as well as the case of two babies 2C.
Figure 2A:
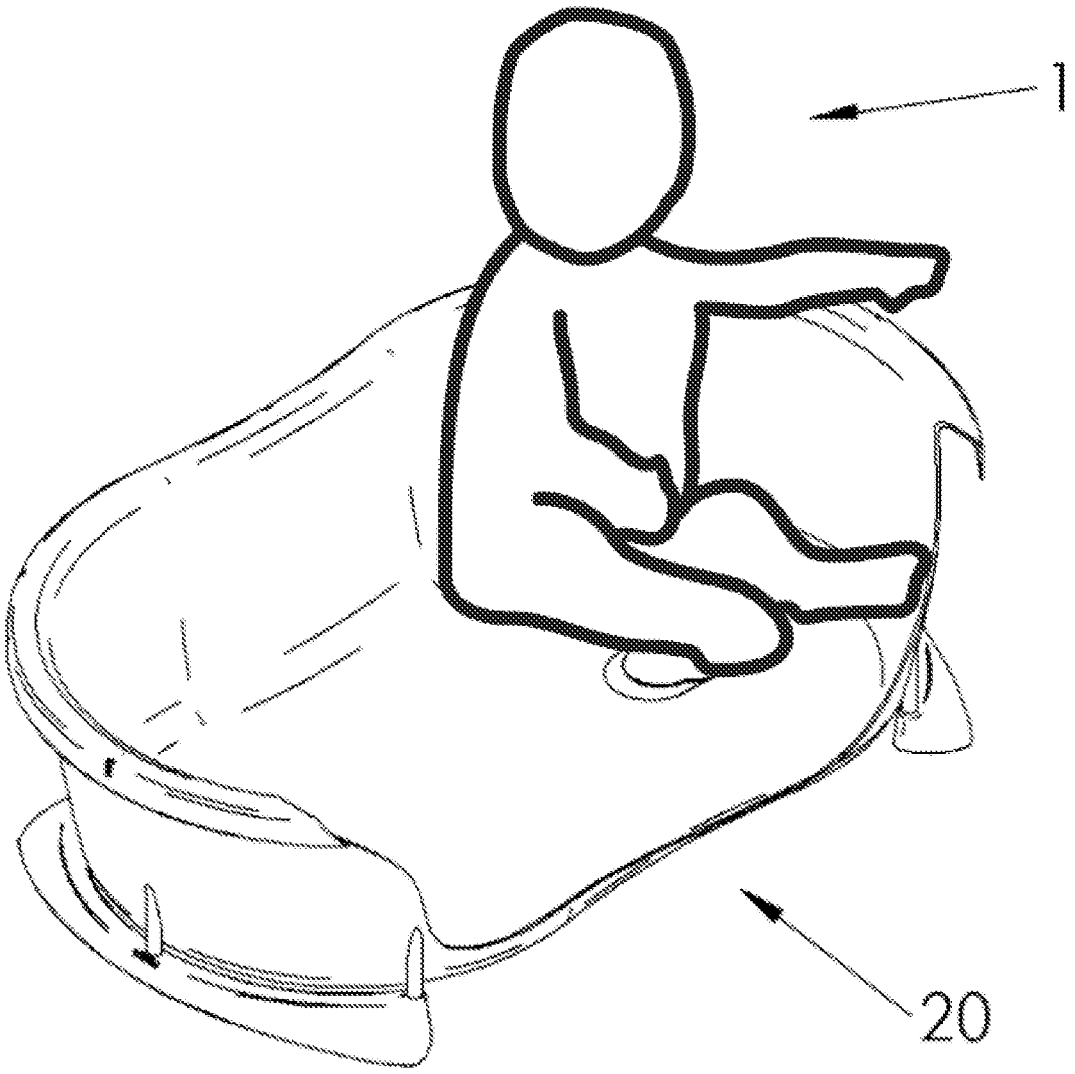
FIG. 2D shows a section.
Figure 2B:
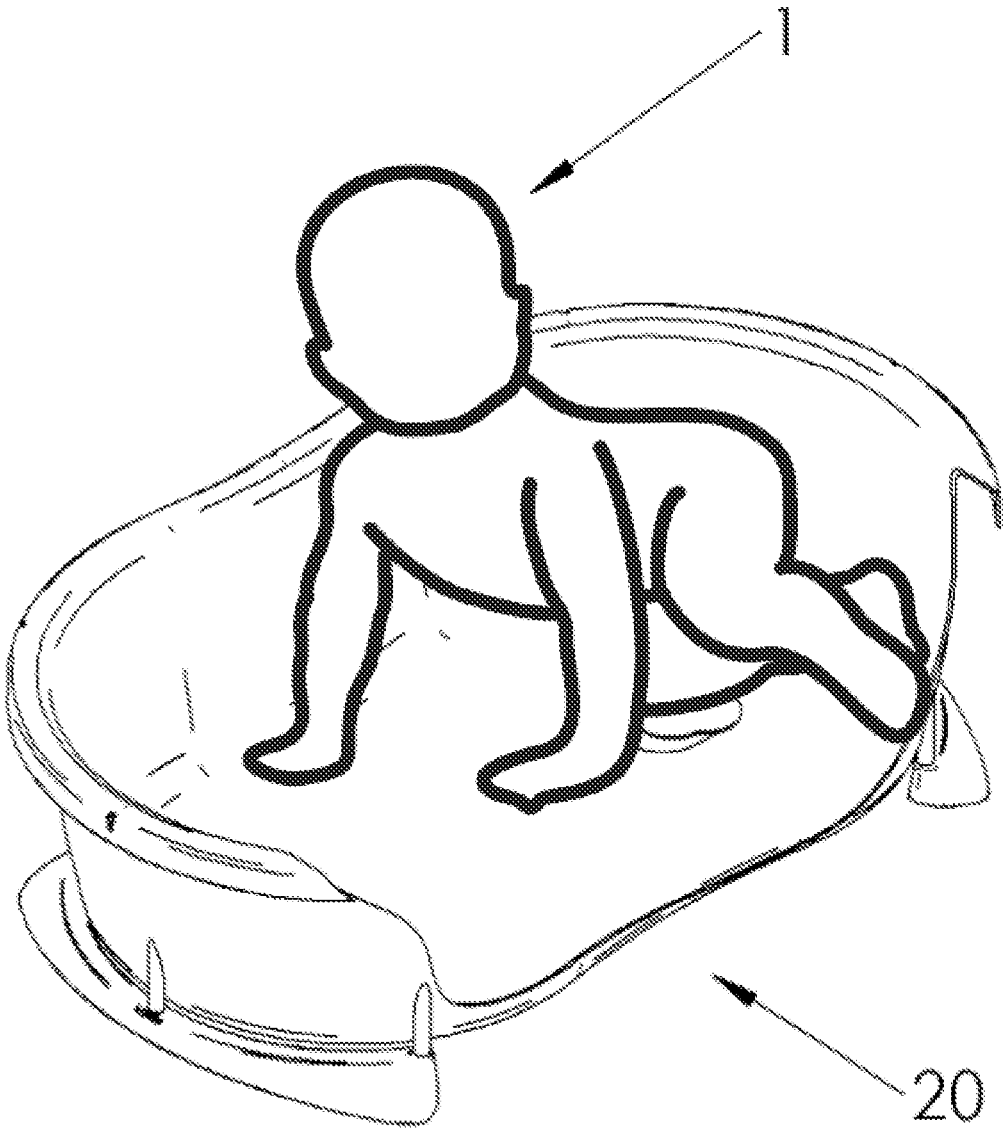

At their second stage of development, that is to say for a baby (1) who can be seated either by themselves or with the assistance of an adult, an embodiment illustrated in FIG. 2 is proposed.

This embodiment comprises a basin (20) whose floor (111) is substantially flat and whose wall shape allows the baby (1) to sit in different positions transversely and longitudinally.

The transverse position allows the seated baby (1) to use the opposite edge to support himself with his feet. The basin (20) must be large enough for this. Its flat floor (111) also allows the seated baby (1) to enter and exit the seated position as desired. The feet (120) and (130) of the basin (20) are placed so as to minimize the risk of tipping. These feet are of sufficient height and are fixed in such places that the floor (111) of the basin (20) does not contact the floor of the adult tub, shower or any other surface on which the feet rest. The floor (111) of the basin (20) is made from a strong and elastic material such as polypropylene or similar material. The resilience of the floor (111) of the basin (20) and the distance which separates it from the hard surface which is the bottom of the adult bathtub make it possible to cushion the fall of the baby (1) if it falls. This basin (20) is designed to retain water during the baby's bath (1). A plug (150) made from a resilient material that does not allow the passage of water is provided covering the location of the drain hole.

Figure 2C:
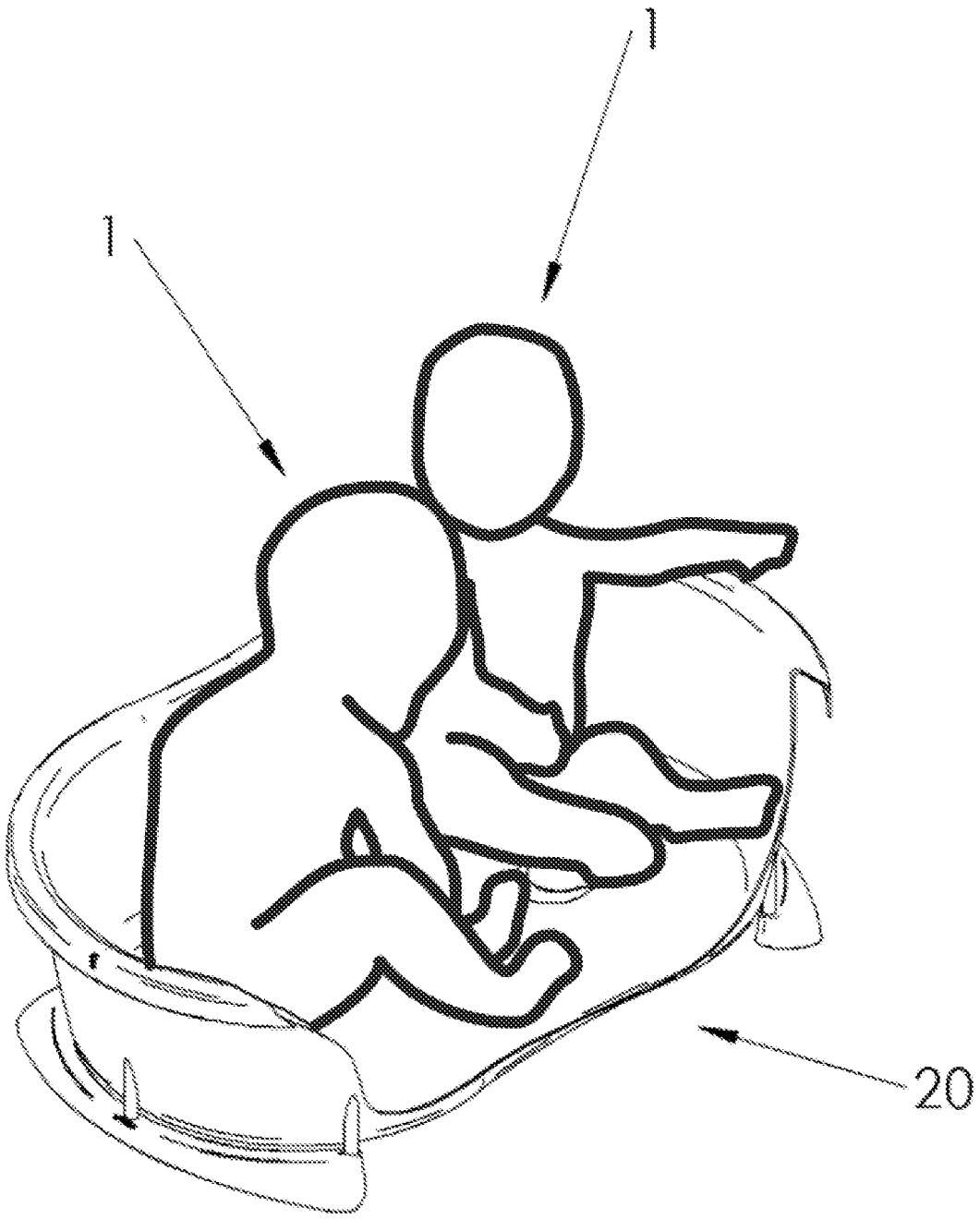
Figure 2D:
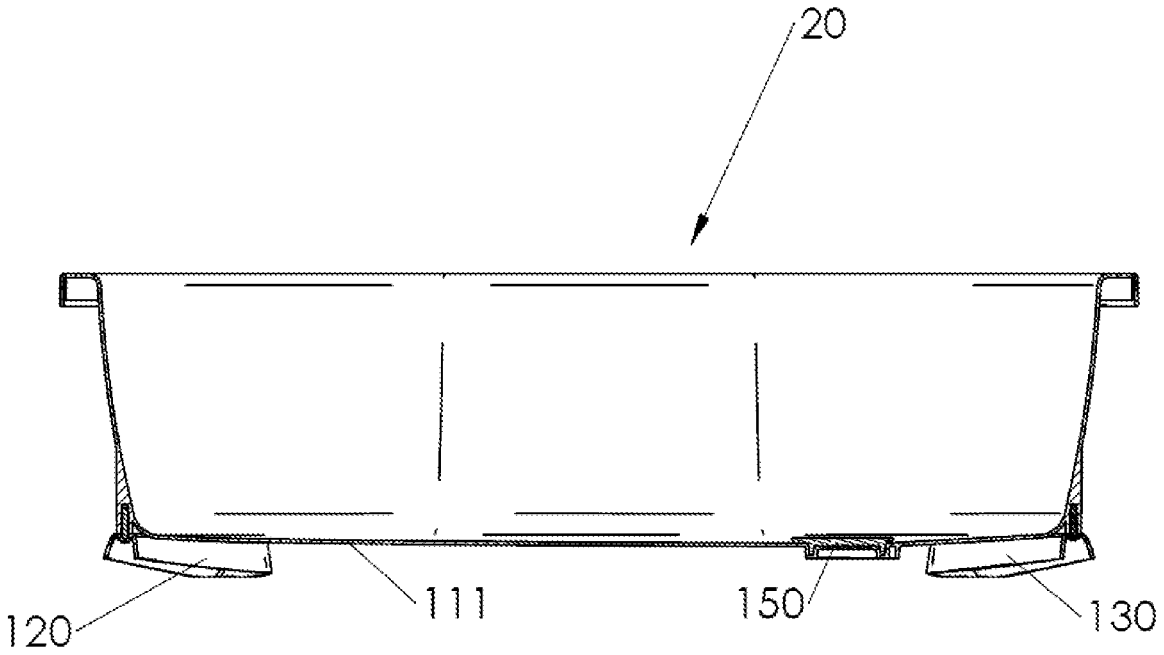

Preferably, it is also possible to design it to allow simultaneous use by at least two infants (1) as is the case in the embodiment illustrated in FIG. 2C, which has several locations in the seated position.

Figure 3:
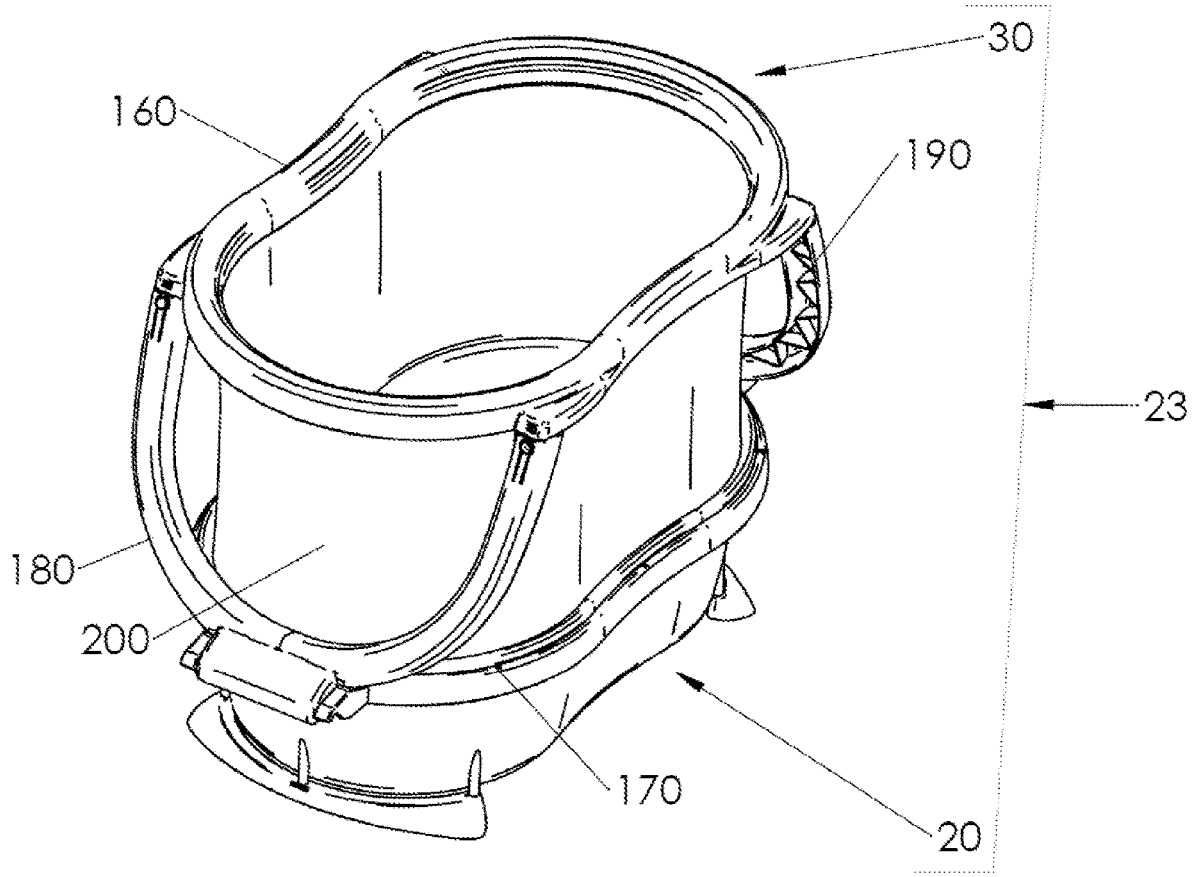
FIG. 3 illustrates an embodiment of the present invention adapted to the third stage, that is for babies who can sit up on their own, stand and move around. See FIGS. 3A, 3B and 3C.

At their third stage of development, that is to say for a baby (1) who can sit up on their own and stand, it is proposed in FIG. 3 a bathing device (23) comprising a basin (20) capable of retaining water and a barrier (30) comprising a flexible wall (200) connected to an upper frame (160) and a lower frame (170), adapted to allow a baby (1) to sit, bend, kneel, walk, crawl.

Figure 3A:
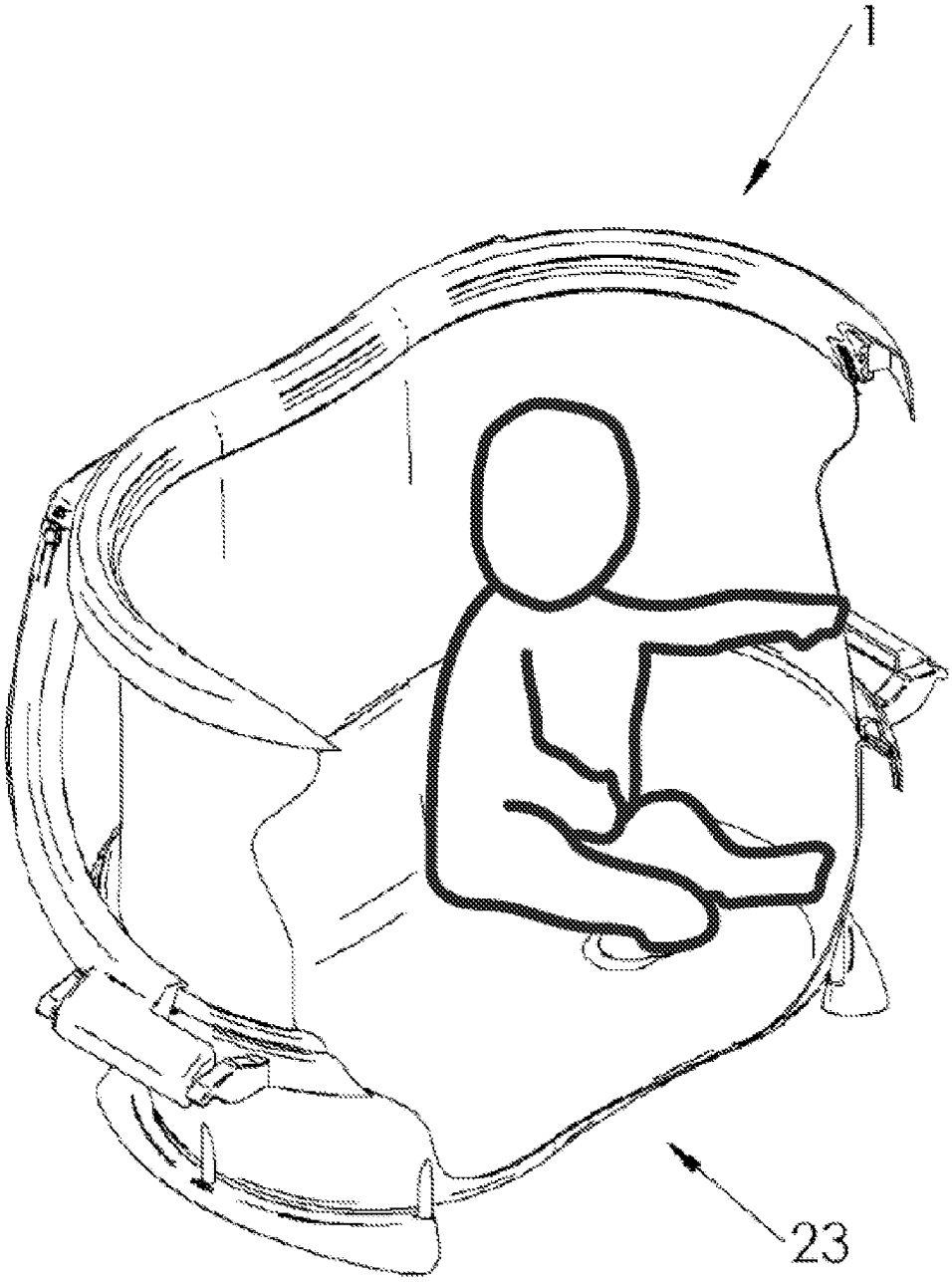
FIG. 3D shows this embodiment in a side view in the open position.
FIGS. 3E and 3F show detail of the attachment points of the ends of the arms.
FIG. 3G shows this embodiment in a side view in the closed position.
FIG. 3H shows the periphery part in perspective view.
FIG. 3J shows the detail of the attachment of the flexible wall to the upper frame.
FIG. 3K shows the detail of the locking-unlocking of the upper end of the arm to the upper frame.
FIG. 3L shows the detail of the attachment of the flexible wall to the lower frame.

Different positions of the baby (1) are also illustrated:

FIG. 3A the case of a seated baby (1)

Figure 3B:
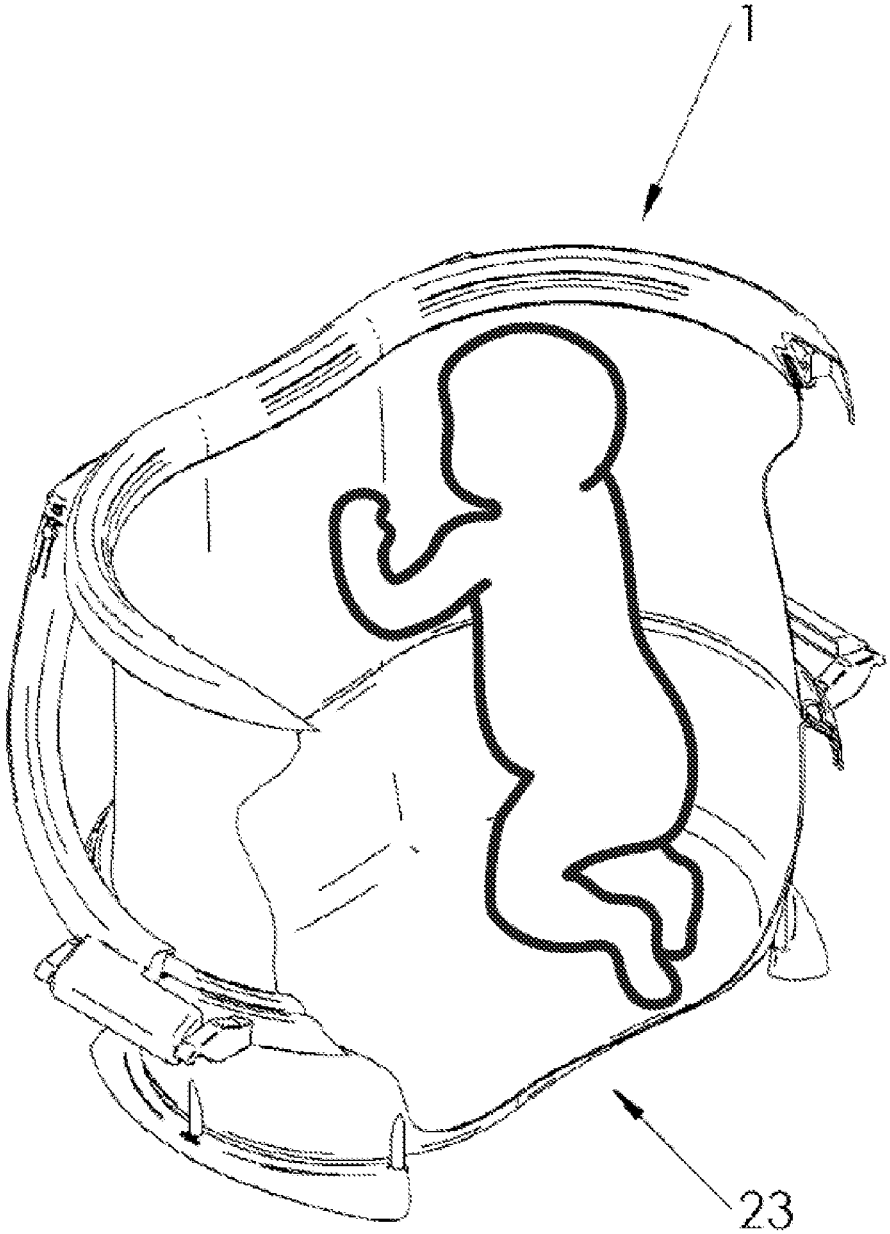

FIG. 3B the case of the baby (1) kneeling

Figure 3C:
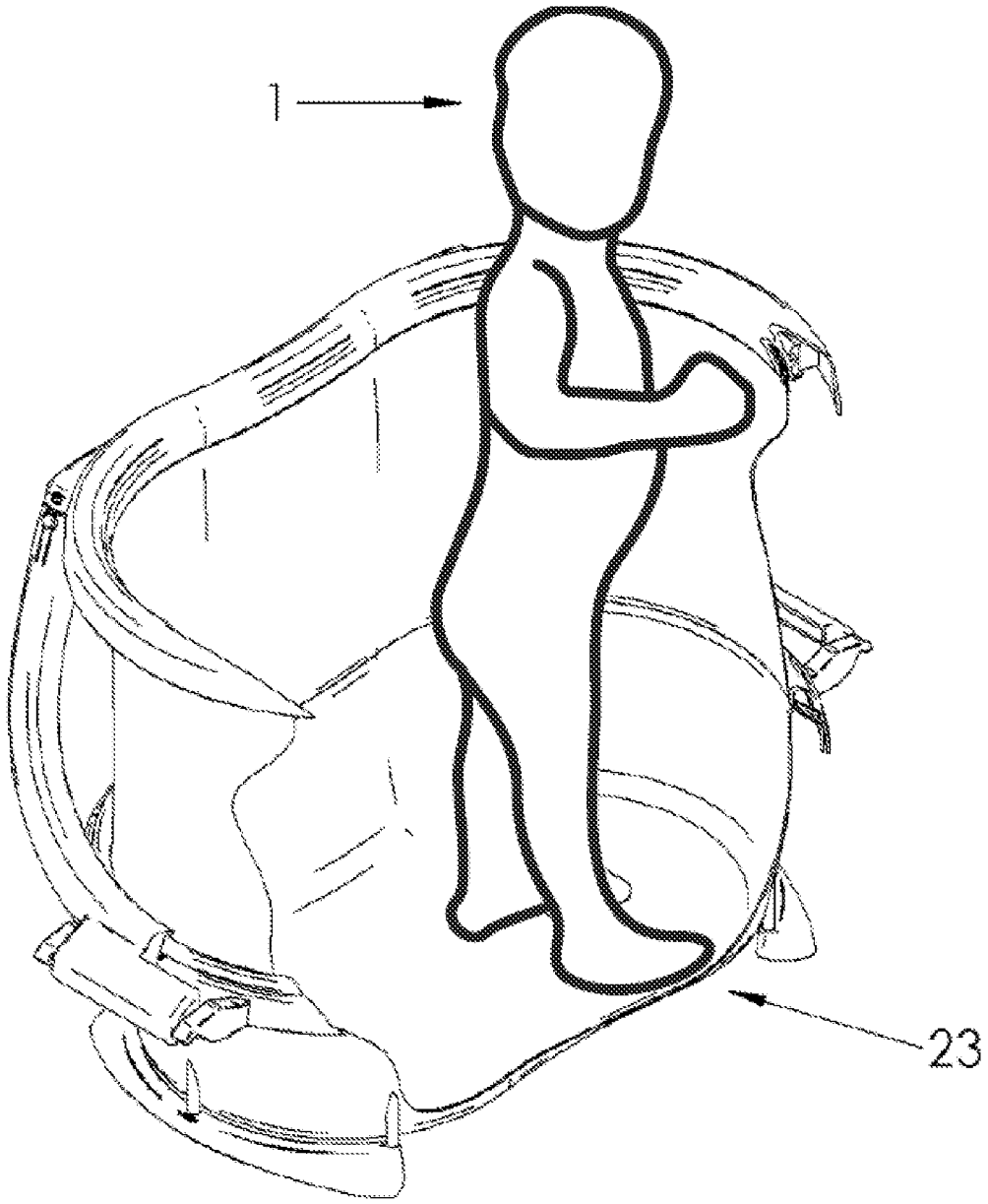

FIG. 3C the case of the standing baby (1).

Figure 3D:
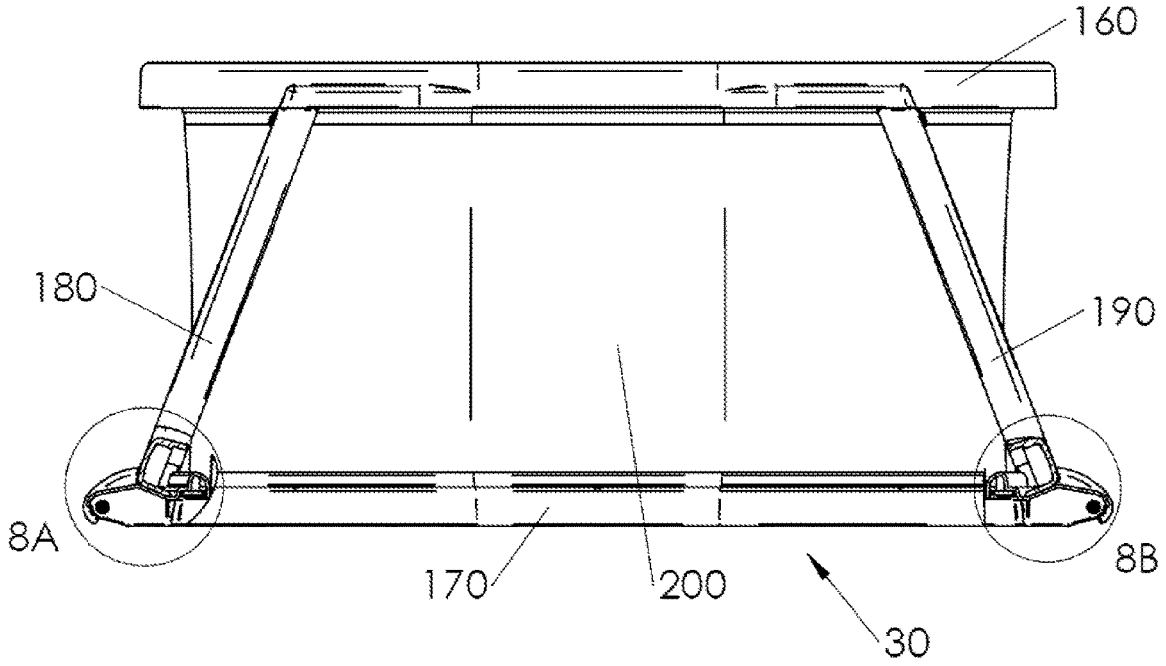
Figure 3G:
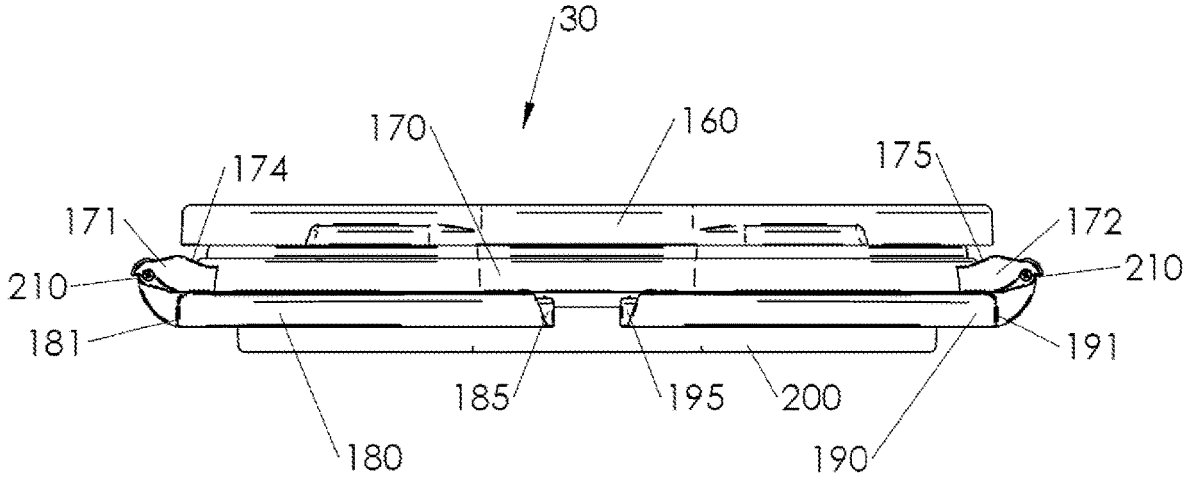

In this embodiment, the barrier (30) is foldable: FIG. 3D shows the side view of the barrier (30) in the open position. FIG. 3G shows the side view of the barrier (30) in the closed position.

To fold and unfold the barrier (30), two rotatable arms (180) and (190) are to be manipulated by the user to go from open position to end and vice versa.

The upper frame (160) is designed to be a handrail at the optimum height for the baby (1). It is high enough so that the child cannot trip over it, fall out or climb over, but low enough so that he can grasp it and support himself. The arms (180) and (190) therefore have the appropriate length.

The flexible wall (200) is flexible enough to collapse when the structure is collapsed. This flexible wall (200) is made of a mesh fabric or similar material, which allows this type of flexibility. The material of the flexible wall (200) also offers other advantages. It provides flexible walls, for the safety of the child, which allows the child to move freely between the sitting and standing positions and to move and play as he wishes. The material is also permeable to water, so the water level cannot rise above the basin (20) and is a safety hazard. The flexible wall (200) forms a continuous surface without holes or slits large enough to allow a child to pass through or use handles or fulcrums to exit.

Figure 3E:
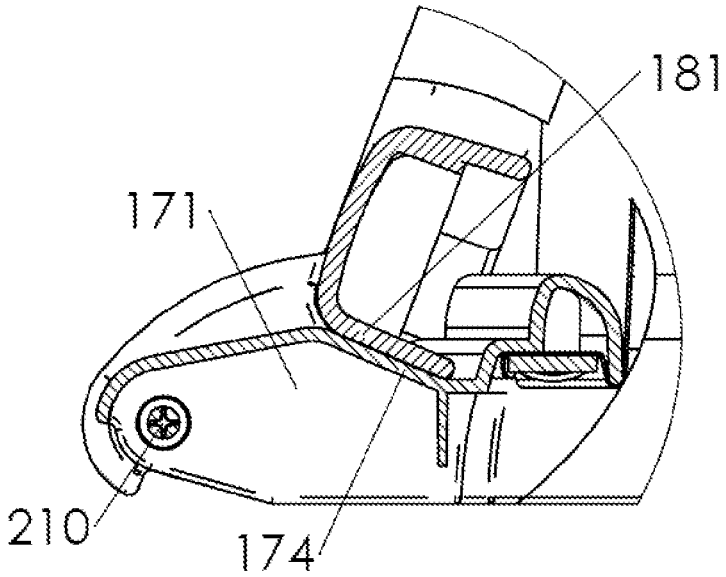
Figure 3F:
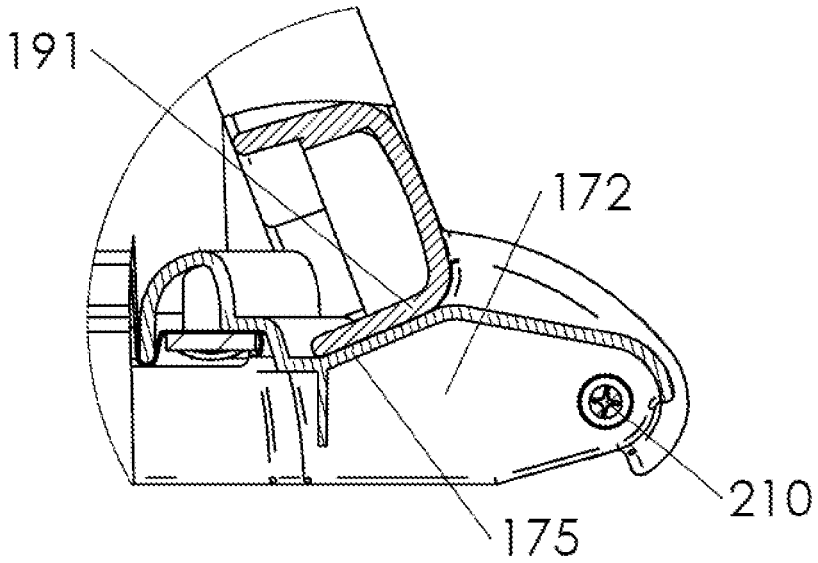

FIGS. 3E and 3F show the detail in section of the attachment points of the surfaces (181) and (191) of the rotatable arms (180) and (190). The rotatable arms (180) and (190) pivot relative to the axes (210). In the open position, the surfaces (181) and (191) respectively bear on the surfaces (174) (175) of the hinge supports (171) (172). In the closed position, the rotatable arms (180) and (190) are substantially horizontal and the surfaces (181) and (191) respectively are no longer resting on the surfaces (174) (175) of the hinge supports (171) (172).

Figure 3H:
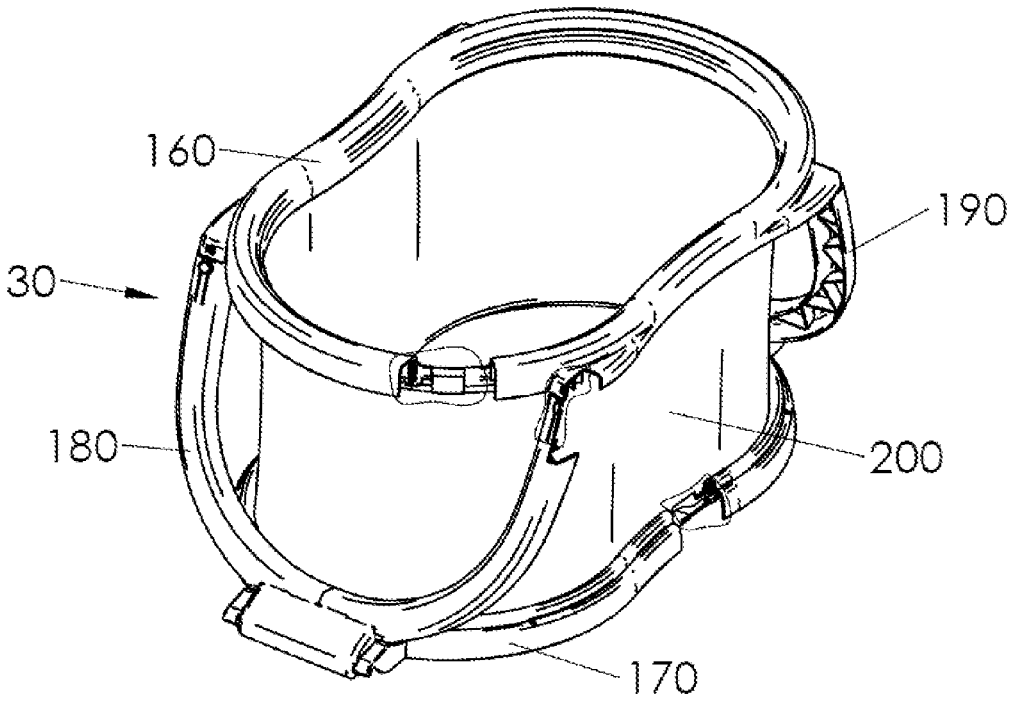
Figure 3J:
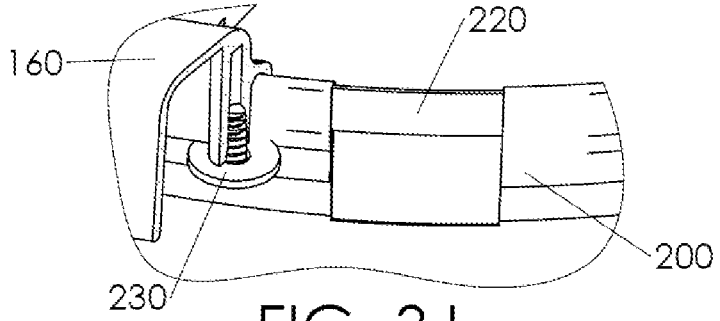
Figure 3K:
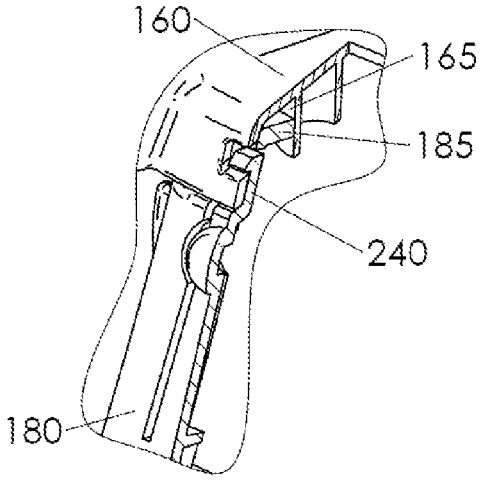

FIG. 3K shows the detail of the locking-unlocking of the upper end (185) of the arm (180) to the upper frame (160). When the arm (180) is manipulated by the user to unfold the barrier (30), he places the upper end (185) of the arm (180) in the housing (165) and clip it to obtain its locking. To fold up the barrier (30), he must first unlock the arm (180) as well as the other arms by pressing on the flexible part (240) of the end (185).

Preferentially, the tensioning of the flexible wall (200) such as mesh fabric or the like contributes to the good mechanical behavior of the periphery.

The flexible wall (200), fixed to the upper frame (160) and to the lower frame (170), prevents the baby (1) standing or crawling out of the enclosure. The tension created in the flexible wall (200) when it is stretched when the barrier (30) is in the open position helps to further press the surfaces (181) and (191) respectively against the surfaces (174) (175) of the hinge supports (171) (172).

Figure 3L:
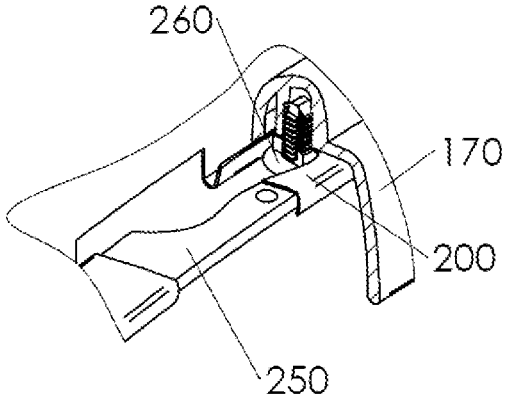

FIG. 3H shows the periphery (30) in perspective view in order in particular to show in detail the way in which the flexible wall (200) is put under tension. FIG. 3J shows the detail of the attachment of the flexible wall to the upper frame. A retaining strip (220) to the upper frame (160) to which the flexible wall (200) is sewn or optionally attached by welding, stitching, adhesives or other means. The retaining band (220) of the upper frame (160) is held in place by clips (230). In other embodiments, the attachment of the flexible wall (200) to the upper frame (160) can be achieved by any of the following means: adhesive, fusion, loops. FIG. 3L shows the detail of the attachment of the flexible wall (200) to the lower frame (170). A lower retaining strip (250) further connected to the flexible wall (200) is secured to the lower frame (170) with clips (260). In other embodiments, the attachment of the flexible wall (200) to the lower frame (170) can be done by any of the following means: adhesion, fusion, stitching.

It is therefore possible to have an appropriate bathing device at each stage of the child's development.

In particular, it is possible to add feet of different lengths to the basin (10) comprising surface (101).

The present invention provides an embodiment in the form of a modular structure which makes it possible to combine the necessary components.

Although the stages of development of the baby (1) correspond to an increasingly larger size of the baby (1) and thus to bathing devices which are a priori incompatible with each other, the present invention comprises an improvement consisting in defining a projected surface on the ground which is substantially similar and in creating a physical interface common to the three bathing devices of the three stages of development of the baby.

In this mode of realization of a modular structure, it is necessary in particular to adapt the shapes of the three bath devices so that they converge towards a shape close to the created interface plane.

Figure 4A:
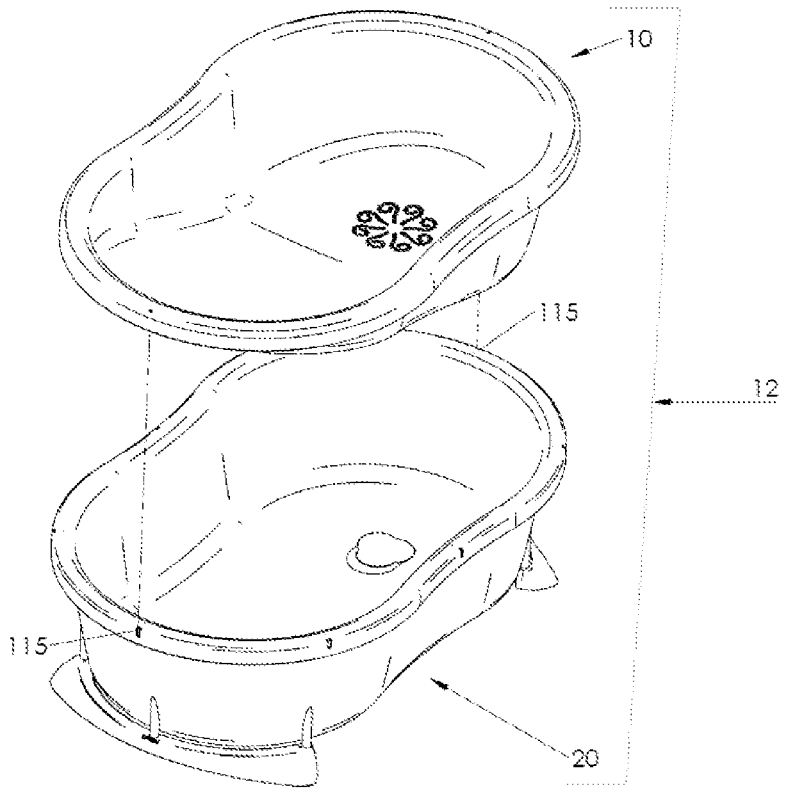
FIGS. 4A and 4B illustrate a variant of the invention consisting of a modular structure combining the basin with its inclined surface and the basin for a seated child.

Once this design work is done, in this mode of realization, illustrated in FIG. 4A in exploded mode, the basin (10) with surface (101) can be placed inside the basin (20) for baby (1) sitting and held in place by any removable fastening means such as clips, snaps, self-gripping tapes. In this mode of realization, these means of fixation are at the locations (115) positioned at the interface between the two components.

Figure 4B:
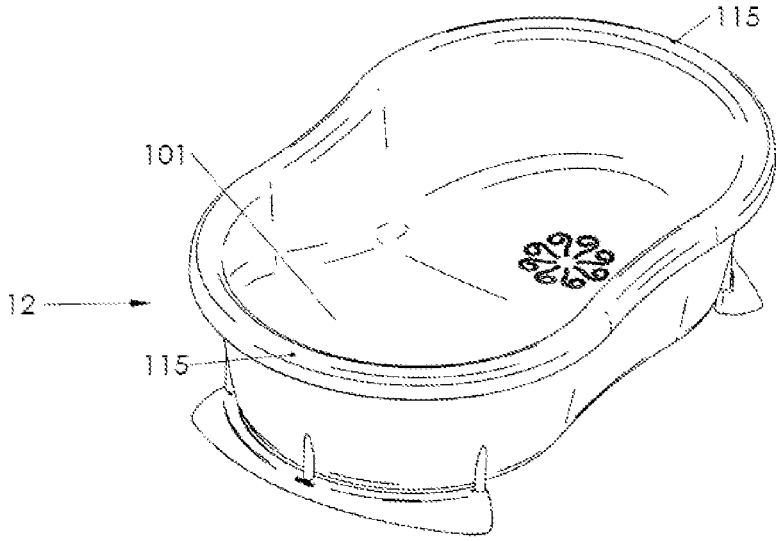

FIG. 4B shows the bathing device (12) resulting from the combination of the basin (10) with surface (101) and of the basin (20) for a seated baby (1), a combination suitable for the first stage of development baby (1).

For the third stage of development of the baby (1), the bathing device (23) shown in FIG. 3 may include a barrier (30) made removable from the basin (20) which may be identical to the basin for a seated baby.

Figure 5:
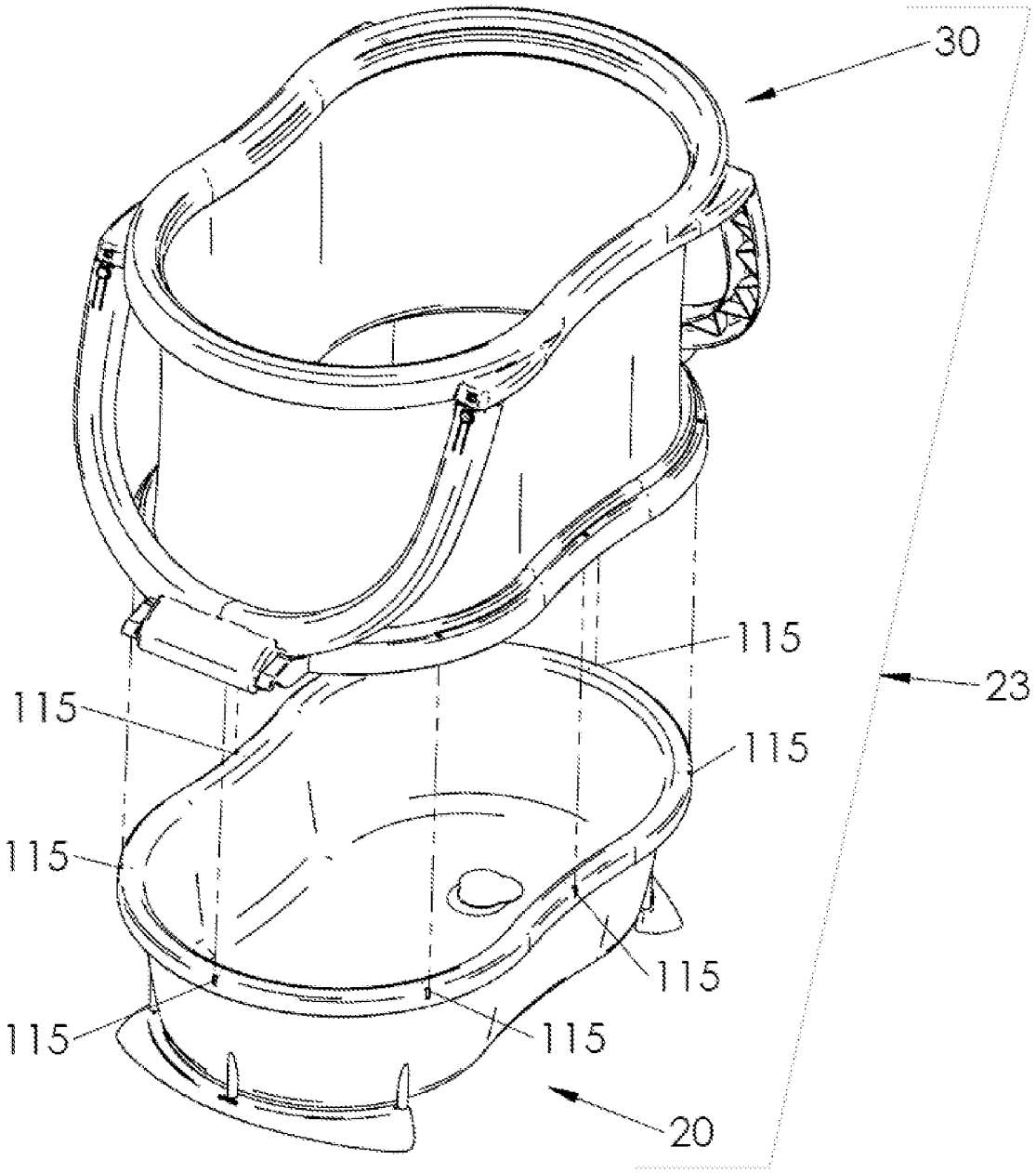
FIG. 5 illustrate a variant of the invention consisting of a modular structure combining the basin for a seated child and the periphery.

As shown in FIG. 5 in exploded mode, in this embodiment, the fixing means are at the locations (115) positioned at the interface between the two constituents the basin (20) for seated baby (1) and the barrier (30) designed to be removable in addition to being foldable.

This modular structure includes the basin (20) adapted to the second stage, that is to say for babies who can be seated, supplemented as the case may be with a basin (10) with surface (101) adapted to the first stage, that is to say for a baby (1) who can neither sit nor stand, or a barrier (30) comprising a flexible wall (200) such as a mesh or equivalent connected to an upper frame (160) and a lower frame (170) adapted to allow a baby (1) to sit, bend, kneel, walk, crawl.

Of course, this modular structure can respond as a whole to the three stages of baby's development by combining its three components, i.e. the basin (20) for seated babies with the basin (10) with surface (101) or the barrier (30).

Finally, it is proposed that the device allow elements other than water such as foam, textiles, sand, gelatin.

Although the invention has already been described with several embodiments, its scope is not limited to the embodiments described, but is intended to cover alternatives, modifications and equivalents. A person skilled in the art will know how to make any variant that conforms to his mind to meet market expectations.

INDUSTRIAL APPLICATION

The device according to the invention is particularly intended for a range of products for bathing a baby (1), from the simplest which would only address a single stage of development to the most complete which would cover the three stages of development of the baby. (1).

I claim:

1. A device for bathing a baby, comprising:

a first basin capable of retaining water, said first basin comprising a floor;

a barrier, removably attached to the first basin, said barrier comprising a flexible wall made of a material permeable to water and connected to an upper frame and a lower frame;

and a second basin, comprising an inclined surface having a minimum width of 30 cm, said inclined surface inclined between 10° and 20° from horizontal, said second basin also comprising a lower part for free movement.

2. The device according to claim 1, characterized in that the second basin has a drain and a plug and that the lower part can be filled with water.

3. The device according to claim 2, characterized in that a physical interface is common between the first basin, the second basin, and the barrier.

4. The device according to claim 3, characterized in that the first basin has feet attached to the floor of the first basin and that the floor of the first basin is raised relative to the feet.

5. The device according to claim 4, in which the first basin comprises oval-shaped walls;

and the floor of the first basin has at least two distinct locations.

6. The device according to claim 3, the frame further comprising rotatable arms having hinge supports;

said flexible wall creating a tension to support the hinge supports.

* * * * *